US010190854B2

(12) United States Patent
Gracia Elizondo et al.

(10) Patent No.: US 10,190,854 B2
(45) Date of Patent: Jan. 29, 2019

(54) SHOOTING TARGET SYSTEM

(71) Applicant: Smart Target Systems LLC, Houston, TX (US)

(72) Inventors: Eduardo Lorenzo Gracia Elizondo, Cypress, TX (US); Alejandro Javier Goldsmith Llorens, Houston, TX (US)

(73) Assignee: Smart Target Systems LLC, Houston, TX (US)

( * ) Notice: Subject to any disclaimer, the term of this patent is extended or adjusted under 35 U.S.C. 154(b) by 194 days.

(21) Appl. No.: 15/185,551

(22) Filed: Jun. 17, 2016

(65) Prior Publication Data

US 2016/0370156 A1 Dec. 22, 2016

Related U.S. Application Data

(60) Provisional application No. 62/182,949, filed on Jun. 22, 2015.

(51) Int. Cl.

| | |
|---|---|
| ***F41J 5/056*** | (2006.01) |
| ***F41J 1/00*** | (2006.01) |
| ***F41J 5/00*** | (2006.01) |
| ***F41J 1/10*** | (2006.01) |
| ***F41J 5/02*** | (2006.01) |
| ***F41J 5/04*** | (2006.01) |
| ***F41J 5/06*** | (2006.01) |
| ***F41J 5/14*** | (2006.01) |

(52) U.S. Cl.

CPC ..... *F41J 5/056* (2013.01); *F41J 1/00* (2013.01); *F41J 1/10* (2013.01); *F41J 5/00* (2013.01); *F41J 5/02* (2013.01); *F41J 5/04* (2013.01); *F41J 5/06* (2013.01); *F41J 5/14* (2013.01)

(58) Field of Classification Search

None

See application file for complete search history.

(56) References Cited

U.S. PATENT DOCUMENTS

| | | | | |
|---|---|---|---|---|
| 3,727,069 | A * | 4/1973 | Crittenden, Jr. | F41J 5/02 250/206.2 |
| 8,523,185 | B1 * | 9/2013 | Gilbreath | F41J 5/056 273/348 |
| 2005/0017456 | A1 * | 1/2005 | Shechter | F41J 5/056 273/371 |

(Continued)

*Primary Examiner* — Jason T Yen

(74) *Attorney, Agent, or Firm* — William C. Yarbrough, III; Kearney, McWilliams & Davis, PLLC

(57) ABSTRACT

A shooting target system exhibiting a ballistic plate having a front face, capable of being struck by aimed projectiles, and an opposed rear face which is made to accept an array of sensors for the detection and transmittal of ballistic strike information. The array of sensors is applied to the opposed rear face and is made to cover a major portion of the rear face. Each sensor is responsive to discrete areas of vibration of the ballistic plate, resulting from a projectile strike, which generates a strike signal that is transmitted to a processor connected to each of the sensors. The processor determines which of the sensors is/are first activated by a projectile strike during a limited time interval and calculates the location of a projectile strike based on the location of the activated sensors and whether each sensor's input is above or below a preselected threshold.

20 Claims, 15 Drawing Sheets

Reference Voltage Circuit

(56) References Cited

U.S. PATENT DOCUMENTS

| | | | | |
|---|---|---|---|---|
| 2010/0038854 | A1* | 2/2010 | Mraz | F41J 5/041 273/371 |
| 2012/0198593 | A1* | 8/2012 | Beck | F41H 1/02 2/2.5 |
| 2013/0147117 | A1* | 6/2013 | Graham | F41J 7/04 273/393 |
| 2014/0367918 | A1* | 12/2014 | Mason | F41J 5/04 273/371 |
| 2014/0368083 | A1* | 12/2014 | Ohashi | C08L 77/04 310/311 |
| 2015/0247709 | A1* | 9/2015 | Roberts | F41J 5/14 340/540 |
| 2015/0330749 | A1* | 11/2015 | Miller | F41J 5/14 340/539.1 |

* cited by examiner 4-to-16 line decoder/demultiplexer

Latch IC

SHOOTING TARGET SYSTEM

CROSS-REFERENCE TO RELATED APPLICATION

This application claims the benefit of U.S. Provisional Patent Application No. 62/182,949 filed on Jun. 22, 2015, entitled "SYSTEM TO DETECT OR LOCATE BULLET IMPACT," which is hereby incorporated by reference in its entirety for all that is taught and disclosed therein.

FIELD OF THE INVENTION

The present invention relates to projectile targets, and more particularly to a shooting target system that detects and locates the impact of a bullet on the target.

BACKGROUND OF THE INVENTION

Target practice requires the participant to fire projectiles at a specified target, typically to improve the participant's aim. Conventionally, persons are trained in the use of firearms at firing ranges by shooting at cardboard or paper targets. Professionals who are required to be skilled in the use of firearms, such as soldiers and police officers, also routinely shoot a targets to maintain their skills. Accuracy is usually assessed by either physically accessing the target and recording the scores after a shooting session, or by viewing the target using a spotting scope.

Various approaches to electronically scoring projectile targets are known in the art. Conventionally, four or more accelerometers or shock or vibration sensors are mounted on a steel plate target to detect a shockwave in the target material. The run-time difference of the shockwave between the different sensors is used to calculate the point of impact of the projectile on the target.

The use of accelerometers as sensors in the prior art has a number of disadvantages. First, because accelerometers measure the intensity of the impact sensor received from the sensors, the system can only be tuned to detect a specific caliber of ammunition because different calibers have very different impact intensities. However, even the same caliber of ammunition can have significant impact intensity variation from cartridge to cartridge, which can adversely affect impact location determination accuracy. Second, accelerometers are relatively expensive, which limits the number that can be economically employed on a target, thereby decreasing the accuracy of the impact location calculation. Third, accelerometers are fragile, to the extent that if a bullet hits the target material where a sensor is located, the sensor is likely to be destroyed and/or detached from the target material. As a result, accelerometers have to be located well away from the desired central aim point on the target material where most bullet impacts will occur, thereby decreasing the accuracy of the impact location calculation. Furthermore, targets with accelerometers as sensors can only be economically utilized by a reasonably skilled shooter who is unlikely to inadvertently shoot a sensor.

Other prior art targets use piezoelectric or vibration sensors to determine location using time difference of arrival (TDOA). When bullet impacts one face of a steel target plate, an initial vibration wave is generated. Once the vibration wave reaches the opposite face of the steel target plate, a second reflection vibration wave is generated. The existence of multiple vibration waves generates an undulatory disturbance corresponding to the combination of two or more elementary waves of similar wavelengths with similar amplitude and relative difference of phase. The sum of these elementary waves produces a resulting wave as shown in FIG. 16.

This resulting wave changes between double or zero amplitude relative to the initial vibration wave generated by the bullet impact. If the resulting wave has zero amplitude as it travels over a piezoelectric or vibration sensor, the sensor will not detect any vibration (amplitude) until the next wave arrives. The sensor's potential inability to detect the resulting wave the first time it travels over the sensor generates a delay, causing the location of impact to be inaccurate. Thus, while it is possible to calculate location using TDOA with piezoelectric or vibration sensors, the location calculation is prone to very low accuracy.

Another disadvantage of the use of TDOA to determine impact location is all vibration from an initial bullet impact must have dissipated before another bullet impact location can be determined. The wait time between shots can range from 0.5 seconds to 5 seconds depending on the target plate material and type of sensor used. As a result, TDOA cannot be used to detect the location of bullet impacts using a firearm with rapid fire capability.

Therefore, a need exists for a new and improved shooting target system that uses a dense array of inexpensive sensors that are protected from bullet strikes to calculate the point of impact of a projectile on a target. In this regard, the various embodiments of the present invention substantially fulfill at least some of these needs. In this respect, the shooting target system according to the present invention substantially departs from the conventional concepts and designs of the prior art, and in doing so provides an apparatus primarily developed for the purpose of providing a shooting target system that detects and locates the impact of a bullet on the target.

SUMMARY OF THE INVENTION

The present invention provides an improved shooting target system, and overcomes the above-mentioned disadvantages and drawbacks of the prior art. As such, the general purpose of the present invention, which will be described subsequently in greater detail, is to provide an improved shooting target system that has all the advantages of the prior art mentioned above.

To attain this, the preferred embodiment of the present invention essentially comprises a ballistic plate having a front face adapted to be struck by aimed projectiles and an opposed rear face, an array of sensors applied to cover a major central portion of the rear face of the plate, each sensor having an output connection and being responsive to vibration of the plate in response to a projectile strike to generate a strike signal on the output connection, a processor connected to each of the sensors, the processor operable in response to a bullet strike to determine which of the sensors is/are first activated by a projectile strike during a limited time interval after the projectile strike, to calculate a projectile strike location based on the locations of the activated sensors. Determining which of the sensors is/are activated may include determining whether or not a voltage generated based on each sensor's output connection is above or below a preselected threshold. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
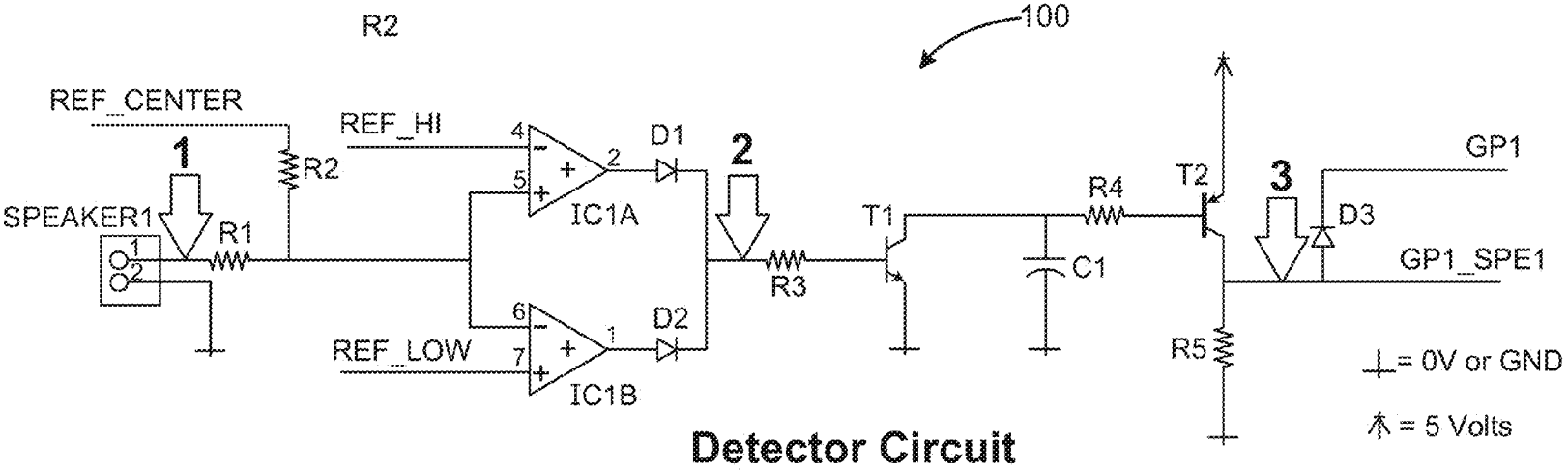
FIG. 1 is a schematic diagram of the detector circuit of the current embodiment of a shooting target system constructed in accordance with the principles of the present invention.

An embodiment of the shooting target system of the present invention is shown and generally designated by the reference numeral 10.

Figure 2:
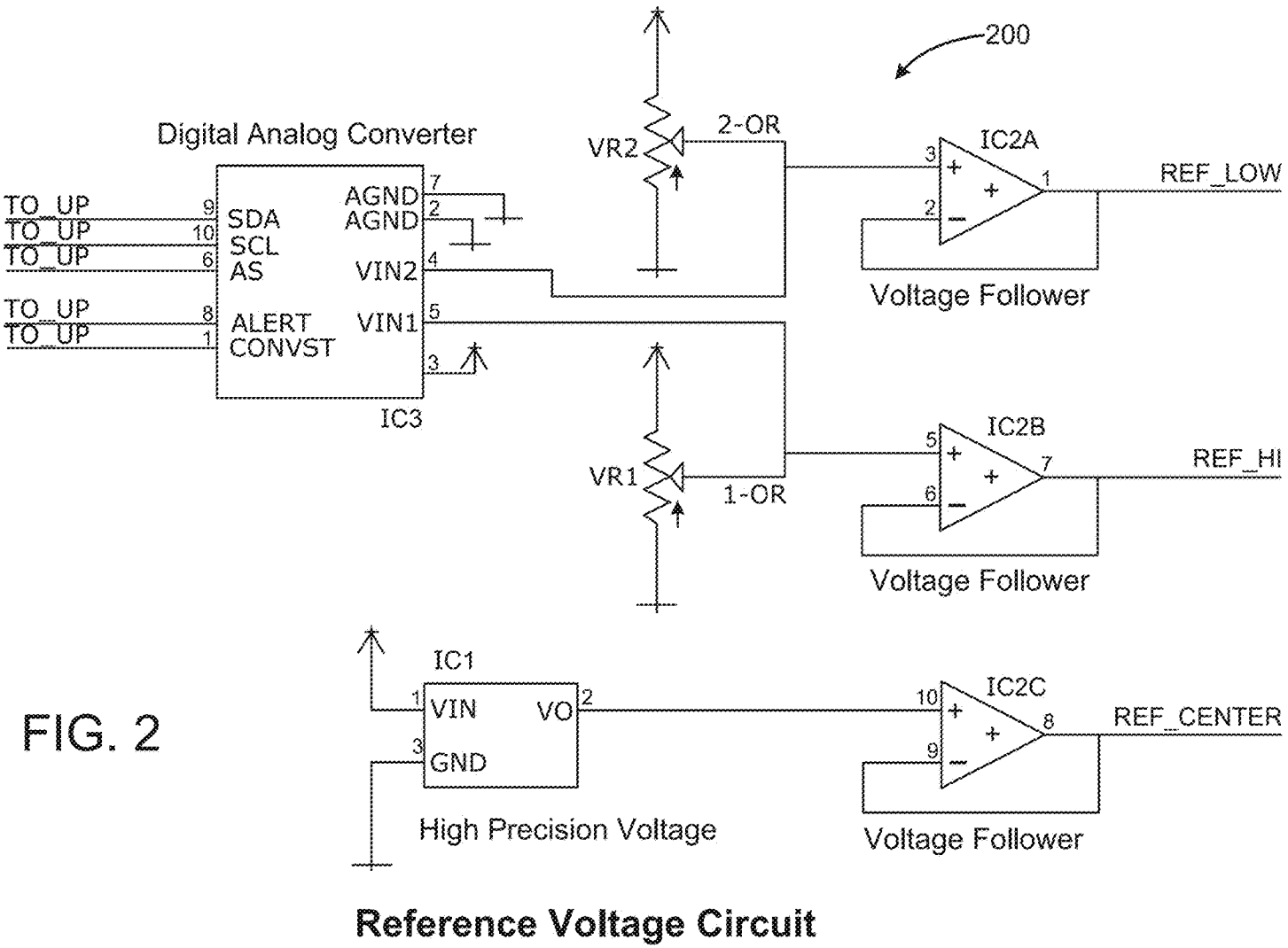
FIG. 2 is a schematic diagram of the reference minimum and maximum threshold voltage circuit of the shooting target system.

FIGS. 1 & 2 illustrate the improved detector circuit 100 and reference voltage circuit 200 of the shooting target system 10 of the present invention. More particularly, as shown in FIG. 1, the voltage generated by a sensor (Speaker 1) responsive to vibration of an attached ballistic target plate 12 may be divided by resistor circuit R1. Since the voltage is AC, it generates negative values if the reference voltage is 0 volts. To solve this, a high precision reference voltage is applied through the Resistor R2 by Voltage Follower circuit IC1 & IC2 as shown in FIG. 2 to the signal line of the sensor(s). This reference voltage, also known as Ref_Center, is received by the comparator IC1 (IC1A & IC1B) as shown in FIG. 1. The comparator will trigger an output when the sensor signal is >REF_HI or the sensor signal is <REF_LOW as shown in FIG. 1. REF_HI and REF_LOW are preselected, tunable voltage thresholds. The thresholds enable the system to be tuned to be sufficiently sensitive to detect impacts from a BB gun or to enable the system to differentiate between residual vibrations and real impacts from a firearm. The system can also be tuned to enable accurate detection of rapid fire. With a sufficiently high threshold, the circuit will only send a signal at the moment of impact and filter out residual vibrations. The voltage thresholds can be adjusted depending on the market being addressed by the shooting target system or can be adjusted by the shooter through a display device 34 (shown in FIG. 15) to change the settings of the IC3 of FIG. 2.

The comparator's signal of the impact is driven through D1 or D2 to trigger transistor T1. The output of transistor T1 charges capacitor C1 and triggers transistor T2. The capacitor C1 holds the charge in order to hold the trigger in T2 while the signal of the sensor transitions from REF_HI to REF_LOW or from REF_LOW to REF_HI. Output of T2 (GP1_SPE1) is the signal that represents the impact of the bullet detected by the sensor. In the current embodiment, the sensor is a piezo electric speaker suitable for generating beeps in inexpensive electronic devices.

Figure 3A:
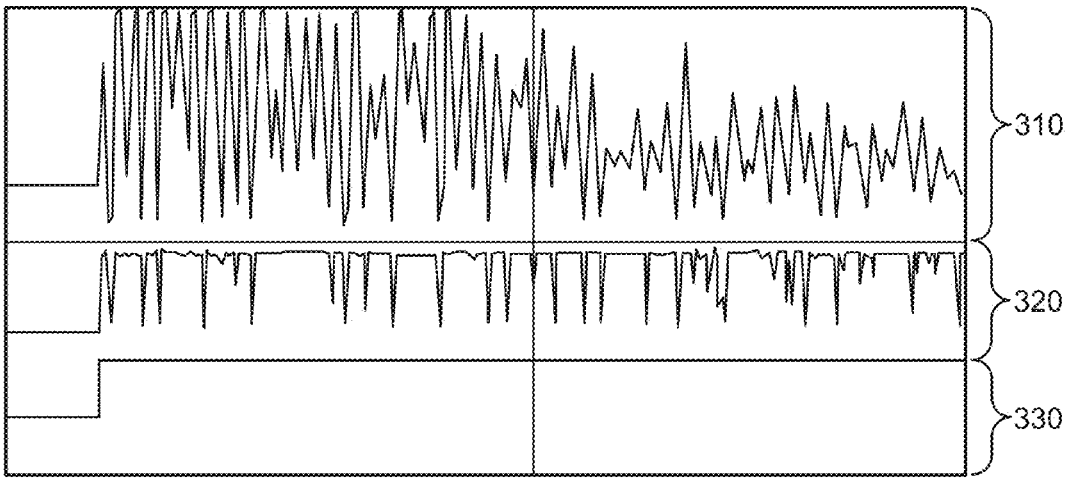
FIG. 3A is a graphical representation of the status of the sensor signals when the signals flow through the detector circuit of FIG. 1 after a bullet impacts the target plate of the shooting target system.

FIG. 3A illustrates how the signal generated by a sensor is affected by flowing through the detector circuit shown in FIG. 1. The points of measure are marked with arrows in FIG. 1. The sensor signal (1) as depicted in section 310 has exceeded the preselected voltage threshold of 250V, the output of the comparator signal (2) is depicted in section 320 (the rectified sensor signal), and the output of the transistor T2 signal (3) is depicted in section 330 and shows the resultant signal (the filtered sensor signal). The signal is driven through diode D3 to interrupt the microprocessor 40 when an impact is detected. There are eight sensors in each group, and each of these groups are connected to the IN of a D-type Flip-Flop. The output of the Flip-Flop is connected by a common 8-bit Data Bus to the microprocessor.

When the bullet impacts the plate, the sensor nearest the impact will generate a signal, and that signal goes to the IN of the D-Type Flip-Flop and through diode D3 to interrupt the microprocessor 40. When the microprocessor is interrupted, the microprocessor activates a timer to allow other sensors to also detect the impact. When a pre-programmed window of time is reached, the microprocessor sends a Clock signal to all Flip-Flops (element 400 of FIG. 7) through the common signal UP_LATCH. At the same time, all the Flip-Flops act as memory to capture the output data from their associated sensors and retain it. After a "picture" of the output of all of the sensors at the same time is taken, the microprocessor sends a binary number to the IC12 (a 4 to 16-line decoder/demultiplexer 44) to activate the Flip-Flops. The Flip-Flops are selected one by one to drive the data stored in the Flip-Flop to the DataBus. The microprocessor takes the data supplied by the DataBus and stores the data in the memory. After reading all of the Flip-Flops, the microprocessor has a map of all of the sensors activated by the impact of the bullet on the target before the impact shockwave has reached the sensors located away from the impact location. The microprocessor can then determine the position of the impact by calculating the average of the signals received.

Figure 3B:
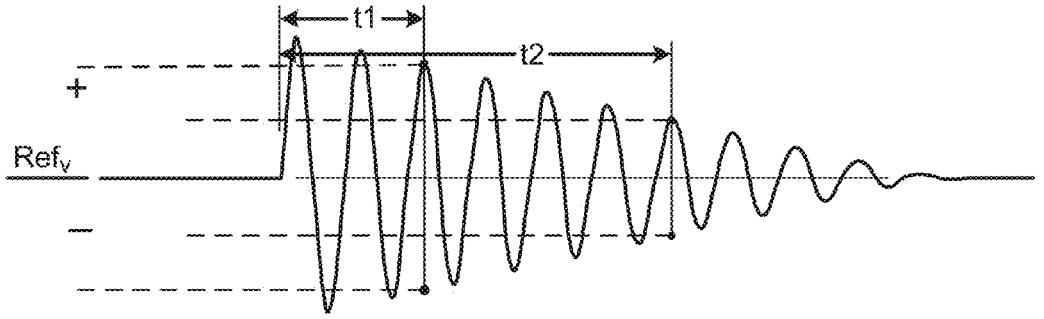
FIG. 3B is a graphical representation of the status of the sensor signals and the preselected voltage threshold that determines the sensor activation condition when the signals flow through the detector circuit of FIG. 1 after a bullet impacts the target plate of the shooting target system.
Figure 4A:
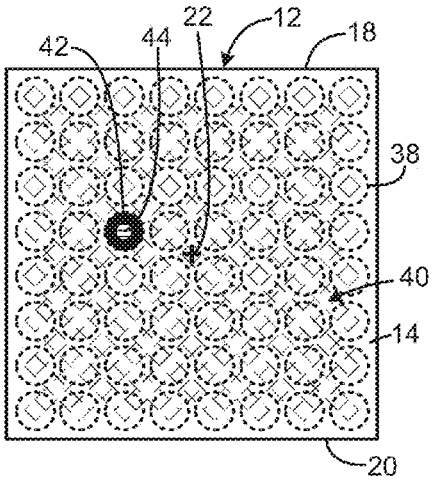
FIG. 4A is a front side view of the shooting target system showing activation of the sensors and the calculated bullet impact location when one sensor is activated by the bullet impact.
Figure 4B:
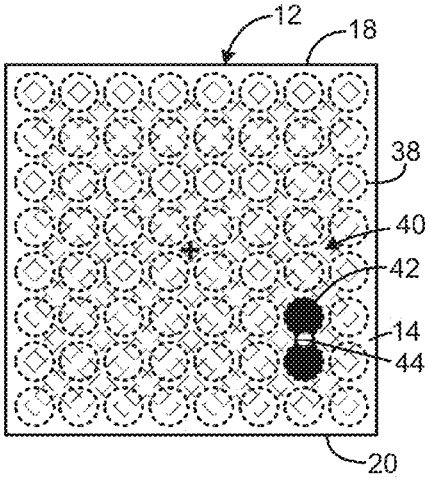
FIG. 4B is a front side view of the shooting target system showing activation of the sensors and the calculated bullet impact location when two sensors are activated by the bullet impact.
Figure 4C:
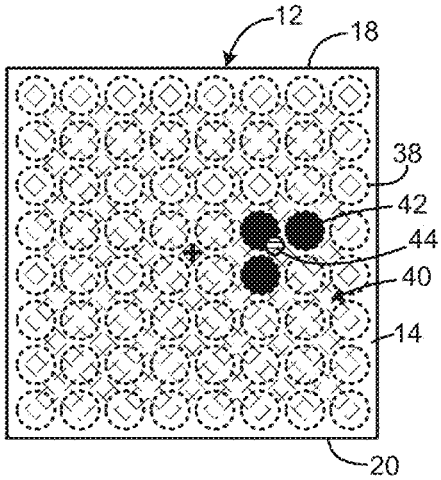
FIG. 4C is a front side view of the shooting target system showing activation of the sensors and the calculated bullet impact location when three sensors are activated by the bullet impact.
Figure 4D:
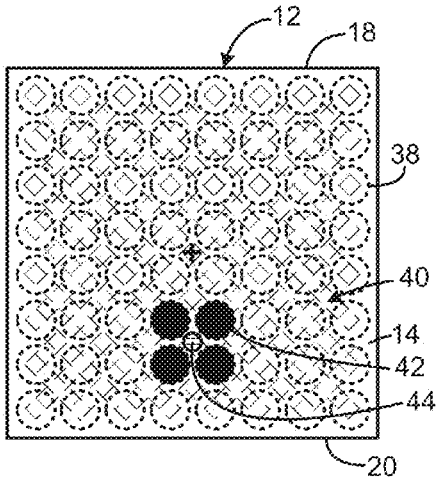
FIG. 4D is a front side view of the shooting target system showing activation of the sensors and the calculated bullet impact location when four sensors are activated by the bullet impact.

FIG. 3B shows the output signal of a sensor in response to the impact of a bullet relative to the preselected voltage threshold. Time interval t1, which is 10 microseconds in the current embodiment, reflects the pre-programmed window of time during which the impact shockwave is allowed to propagate within the target plate material before the sensors' condition is recorded. Time interval t2 reflects the duration of time during which at least one sensor outputs a signal >REF_HI or less than <REF_LOW that triggers an output from the comparator IC1. Once the sensor signal has decayed sufficiently at the end of time interval t2 such that the comparator no longer produces an output, the sensor is considered to be inactive and ready to detect a new impact.

The REF_HI and REF_LOW voltage values are tunable and can be adjusted to account for different sensor signal voltages resulting from bullet speed at impact, firearm type, caliber, bullet type, and the distance between the impact location on the target plate 12 and the sensors 38. The REF_HI and REF_LOW voltage values can also be adjusted to vary the time interval t2 during which the comparator will produce an output after an impact. In the current embodiment, time interval t2 is sufficiently short that over 100 impacting rounds per second can be detected, which enables detection of all of the impacts from substantially all firearms. Time interval t2 is a function of the force of bullet impact and the level of the voltage threshold. The higher the voltage threshold, the faster the system will be ready to detect the next impact. Therefore, if the level of the voltage threshold is adjusted such that t2<1000 microseconds, the system can accurately detect and locate 1,000 impacts per second. Between the end of t1 and the end of t2, the system can locate the impact and wirelessly send it to a display device 34. Furthermore, the sensors of the current invention can detect impacts resulting from both supersonic and subsonic bullets.

FIGS. 4A-D illustrate the four possible sensor activation conditions in response to the impact of a bullet on the target plate 12. In the current embodiment, the target plate is a 12 in.$^2$ steel plate having a front 14, rear 16, top 18, bottom 20, and center 22. An array of sensors 38 is attached to the rear of the target plate. The array of sensors creates a virtual diagonal grid of possible calculated impact locations 40, which defines the impact location resolution since all calculated impact locations will lie in the center of one of the boxes of the grid.

The array of sensors 38 can be positioned in any desired arrangement, including an orthogonal grid/cubic close-packed as shown in FIGS. 4A-D and hexagonal close-packed, which slightly increases sensor density and impact location resolution. The sensors can also be arranged with variable densities, such as a high resolution sensor zone around a major central portion of the rear face of the target plate 12 including a central aiming point 22 where the majority of impacts are expected to occur, and a lower resolution sensor zone encompassing an intermediate portion registered with the aiming point and extending away from the aiming point towards the periphery of the target plate in all directions. The sensor array can consist of any quantity and arrangement of sensors, including at least nine sensors, and including at least three rows and three columns of sensors.

The activated sensor(s) 42 and the calculated impact locations 44 are shown on the target plates 12. Within the pre-programmed window of time t1, one of four sensor activation conditions will always exist. In the condition shown in FIG. 4A, only one sensor is activated when a bullet strikes the target plate directly on top of a sensor, resulting in a calculated impact location at the center of the activated sensor. In the condition shown in FIG. 4B, two sensors are activated when a bullet strikes the target plate sufficiently close to either a vertical axis or a horizontal axis between two adjacent sensors, resulting in a calculated impact location at a midpoint of a line connecting the centers of the adjacent activated sensors. In the condition shown in FIG. 4C, three sensors are activated when a bullet strikes the target plate sufficiently close to the vertex of a right angle connecting three adjacent sensors, resulting in a calculated impact location at a geometric average of the locations of the centers of the L-shaped trio of adjacent activated sensors. In the condition shown in FIG. 4C, four sensors are activated when a bullet strikes the target plate sufficiently close to the center of a square connecting four adjacent sensors, resulting in a calculated impact location at the center of a square formed by connecting the centers of the adjacent activated sensors. In each of these conditions, the calculation of an average position from the activated sensors to represent the impact point is sufficiently accurate to be within 0.9 cm of the actual bullet strike location, while not requiring large amounts of processing power because at most four sensor locations are averaged. However, a more complex calculation employing additional snapshots of sensor data taken at time intervals greater than t1 could also be used to determine the impact location. Calculation of an average position rather than calculating position using time difference of arrival enables a more accurate determination of location and the ability to accurately detect rapid fire.

Figure 5:
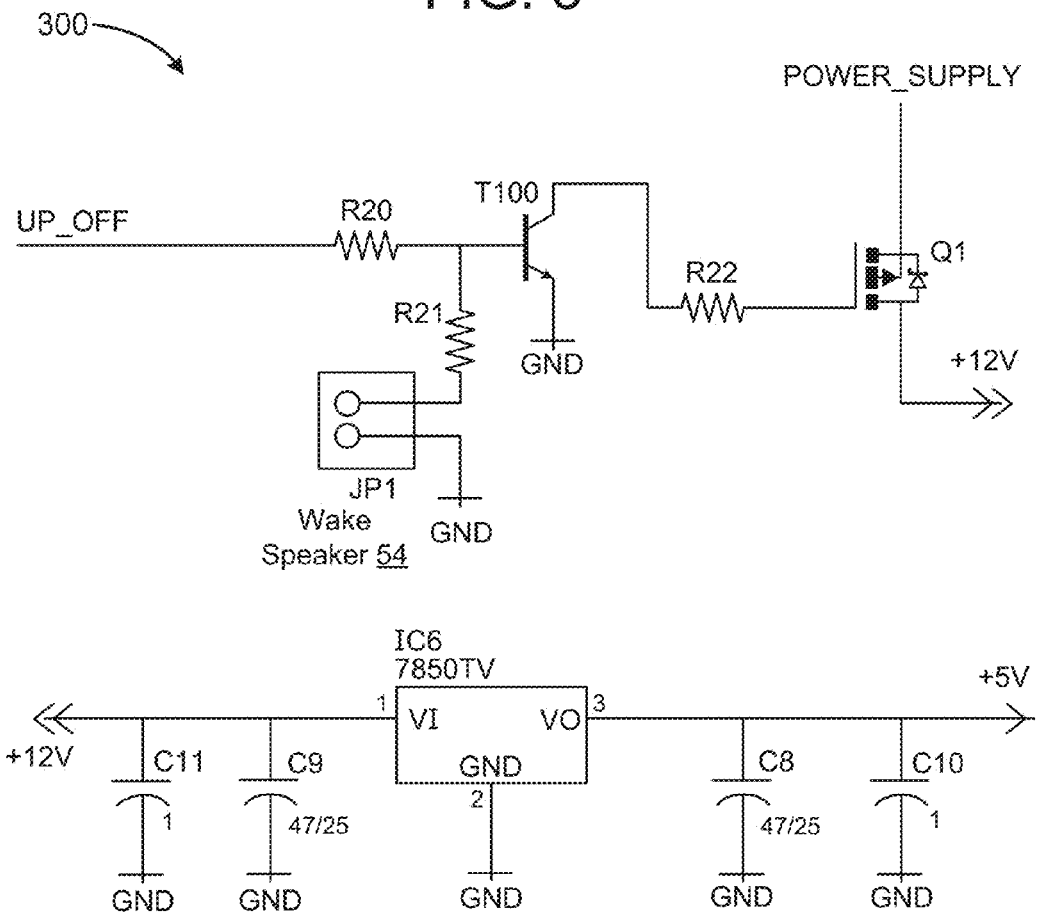
FIG. 5 is a schematic diagram of the wake up sensor circuit of the shooting target system.

FIG. 5 illustrates the wake-up sensor circuit 300 of the shooting target system 10. More particularly, there can be an optional additional wake-up sensor (Wake Speaker 54) separate from the impact locating sensor array composed of sensors 38 that is attached behind the target plate 12 to switch on the shooting target system remotely. To switch the shooting target system On, the shooter 36 fires a bullet at the target plate 12. The wake-up sensor generates a voltage when the bullet hits the target plate. The voltage goes through R21 to the transistor T100 and triggers the mosfet. The mosfet takes the power from the battery 48 or external power supply and drives it to the regulator IC6, which regulates the power supply to the microprocessor 40 at 5V. The microprocessor 40 then wakes up and sends a signal through R20 to trigger transistor T100 before the signal from the wake-up sensor disappears. The microprocessor also initiates a pre-programmed countdown timer, which is 30 minutes in the current embodiment. Each subsequent bullet impact resets the countdown timer to the pre-programmed starting value. When the microprocessor's countdown timer reaches zero, and the microprocessor needs to switch off the shooting target system, the microprocessor sends a 0V signal, which causes the transistor T100 and Q1 to stop work. When that happens, no power passes through Q1, which results in the entire circuit switching OFF because of no energy being present. Power OFF can also be requested by the shooter 36 using the display device 34. In the current embodiment, the wake-up sensor is a piezo electric speaker suitable for generating beeps in inexpensive electronic devices.

Figure 6:
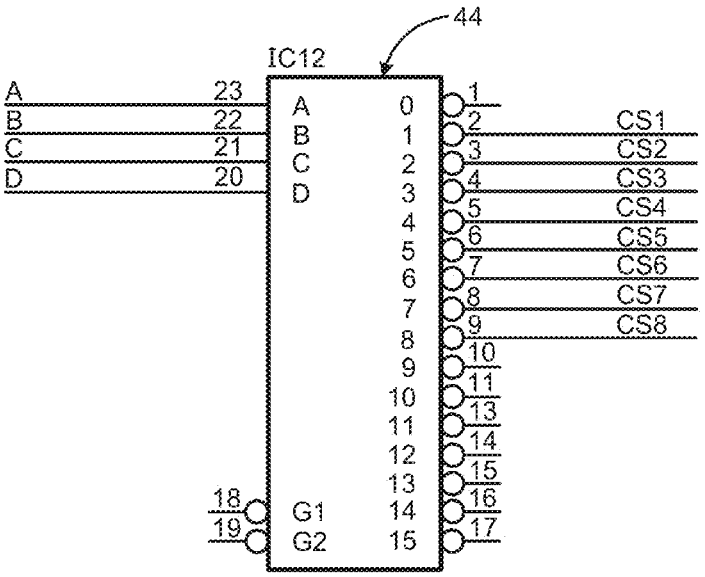
FIG. 6 is a schematic diagram of a supplemental 4 to 16 decoder/demultiplexer if the shooting target system requires more than 15 modules.

FIG. 6 illustrates a supplemental 4 to 16-line decoder/demultiplexer 44 of the shooting target system 10. More particularly, the supplemental decoder/demultiplexer can be installed if the target plate needs more than four modules 52, with each module having eight sensors 38. However, additional external modules are not needed for a target plate 12 with fewer than 120 sensors. In that case, the modules can be set in the main circuit board 26 of the target plate.

Figure 7:
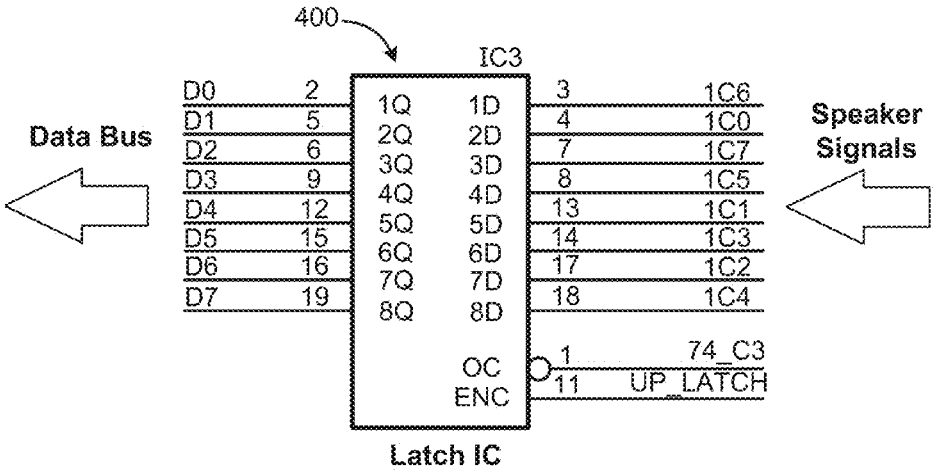
FIG. 7 is a schematic diagram of the circuit of the shooting target system that reads the information received from the eight sensors and sends it to the microprocessor.

FIG. 7 illustrates the circuit 400 of the shooting target system 10 present on a module 52. The circuit 400 reads the signals received from the eight sensors 38 attached to the module and sends the signals to the microprocessor 40.

Figure 8:
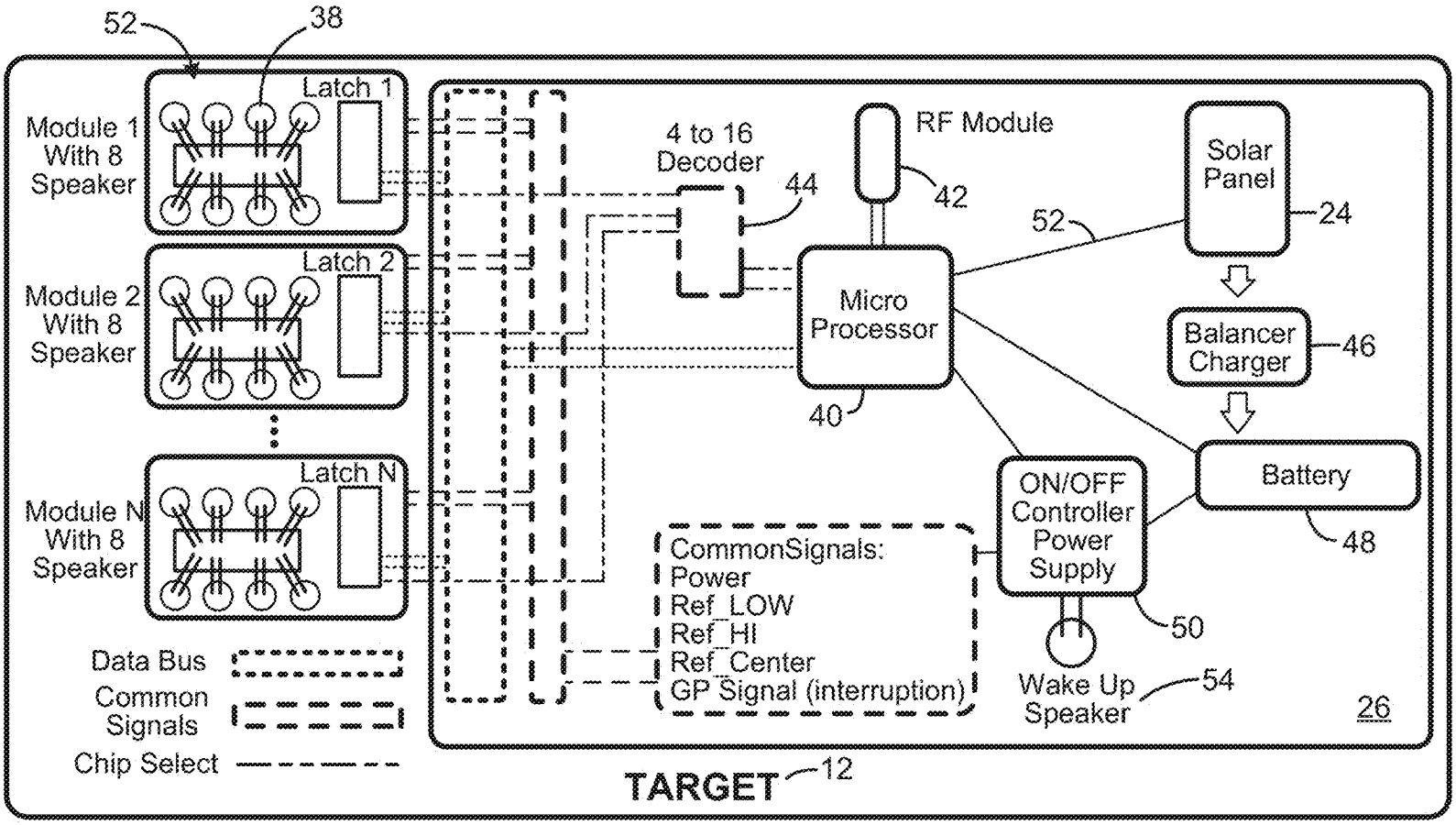
FIG. 8 is a schematic diagram of a target of the shooting target system with three modules attached to it, where each module has eight sensors.

FIG. 8 is a schematic diagram of the target shooting system 10 with a target plate 12 having modules 52 attached to the main circuit board 26, where each module has eight sensors 38. The main circuit board includes a connection to a solar panel 24, a balancer charger 46, a battery 48, an ON/OFF controller power supply 50, a connection 52 to the wake up speaker 54, an RF module 42, the microprocessor 40, and a 4 to 16-line decoder/demultiplexer 44. The target shooting system can accommodate as many modules as are required for the desired quantity of sensors by adding additional modules and, if needed, supplemental 4 to 16-line decoder/demultiplexers 44 either attached to the target plate or located externally to the target plate.

Figure 9:
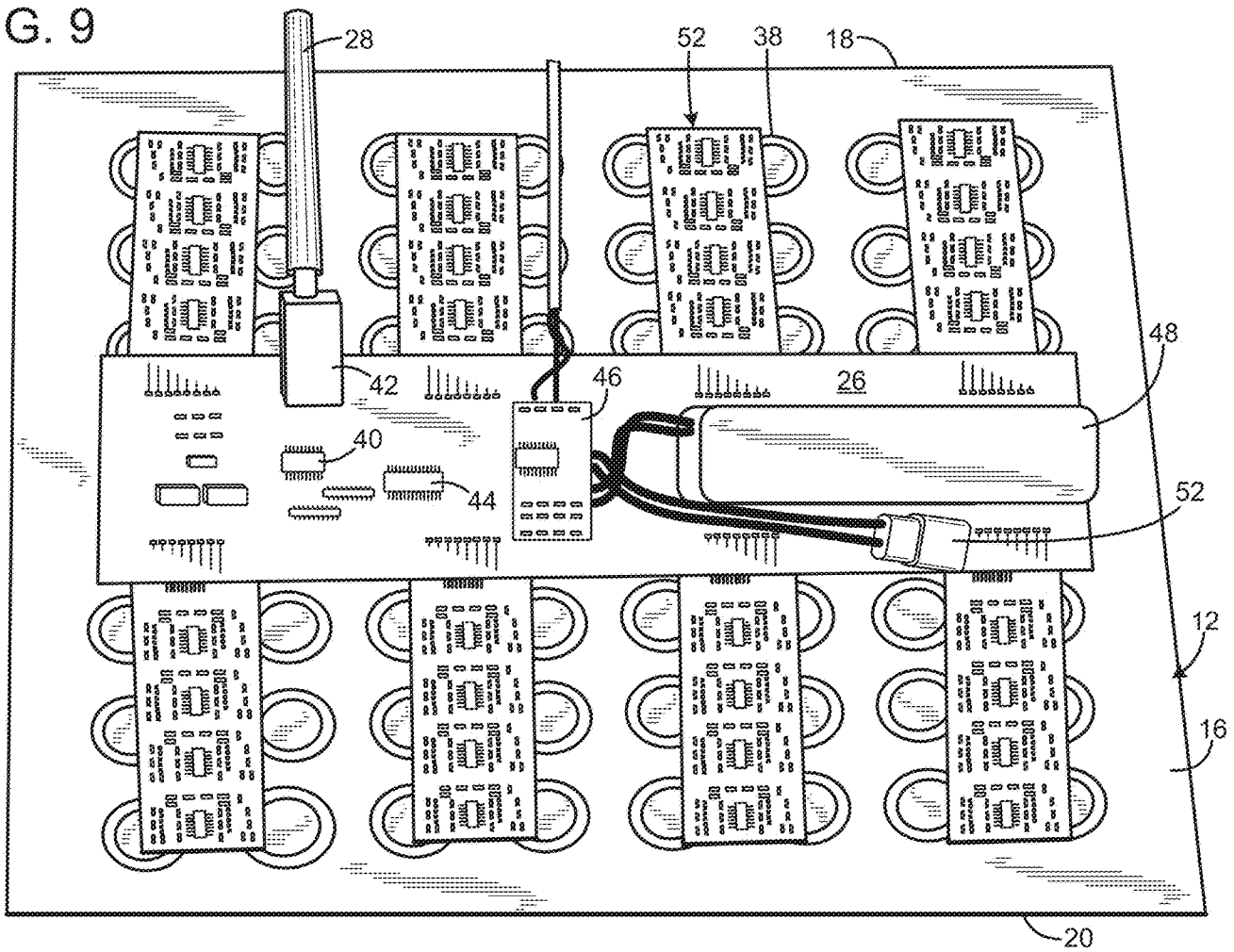
FIG. 9 is a rear view of the shooting target system showing the main circuit board with eight modules attached, where each module has eight sensors.
Figure 10:
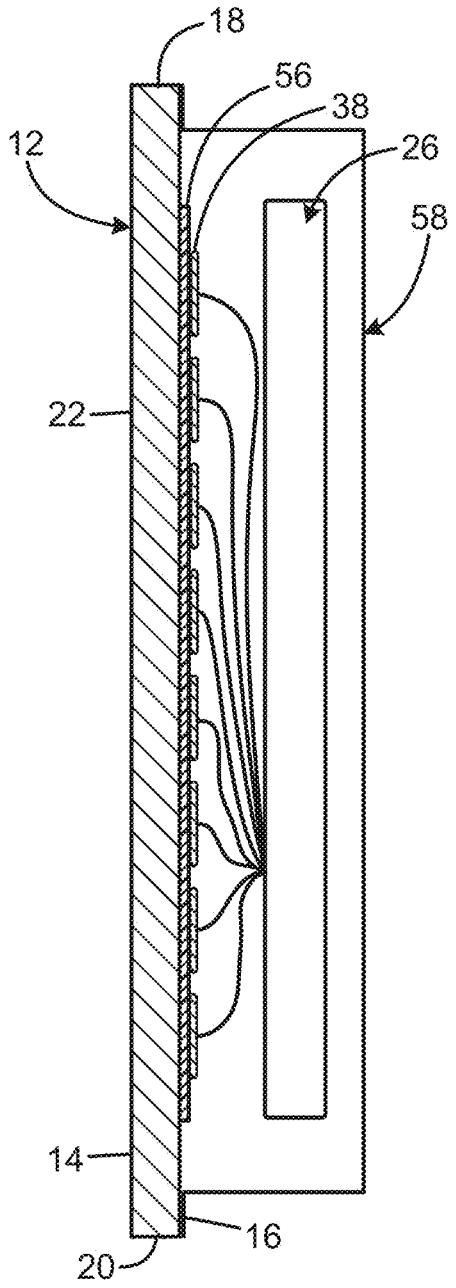
FIG. 10 is a side sectional view of the shooting target system of FIG. 9.
Figure 11:
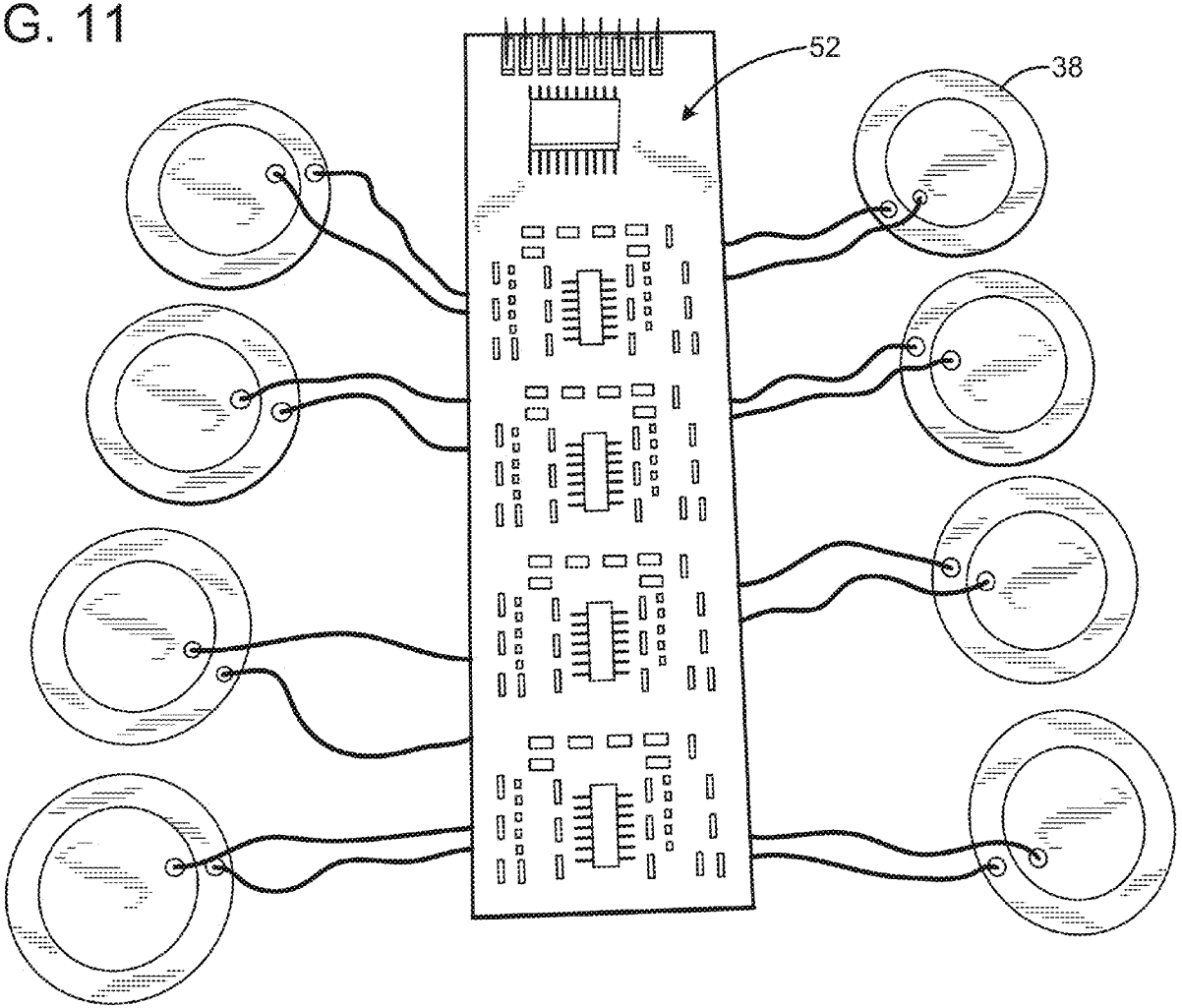
FIG. 11 is an exploded view showing a module with eight sensors of FIG. 9.

FIGS. 9-11 illustrate the target shooting system 10 with a target plate 12 having eight modules 52 attached to the main circuit board 26, with each module having eight sensors 38. A resilient material gasket 56, which is an elastomer in the current embodiment, is located between the rear 16 of the target plate 12 and the sensors 38. The resilient material gasket serves as a shock absorber between the target plate and the sensors, which protects a sensor from breaking if the portion of the target plate directly above the sensor is impacted by a bullet. However, sufficient energy is still transmitted by the bullet impact through the resilient material to activate the sensor. The sensor protection enables the target plate to be positioned at any desired angle without risking damage to the sensors. The resilient material also provides a waterproof seal between the sensor and the target plate to prevent water damage to the sensor. A removable housing 58 protects the main circuit board, modules, and sensors.

Figure 12:
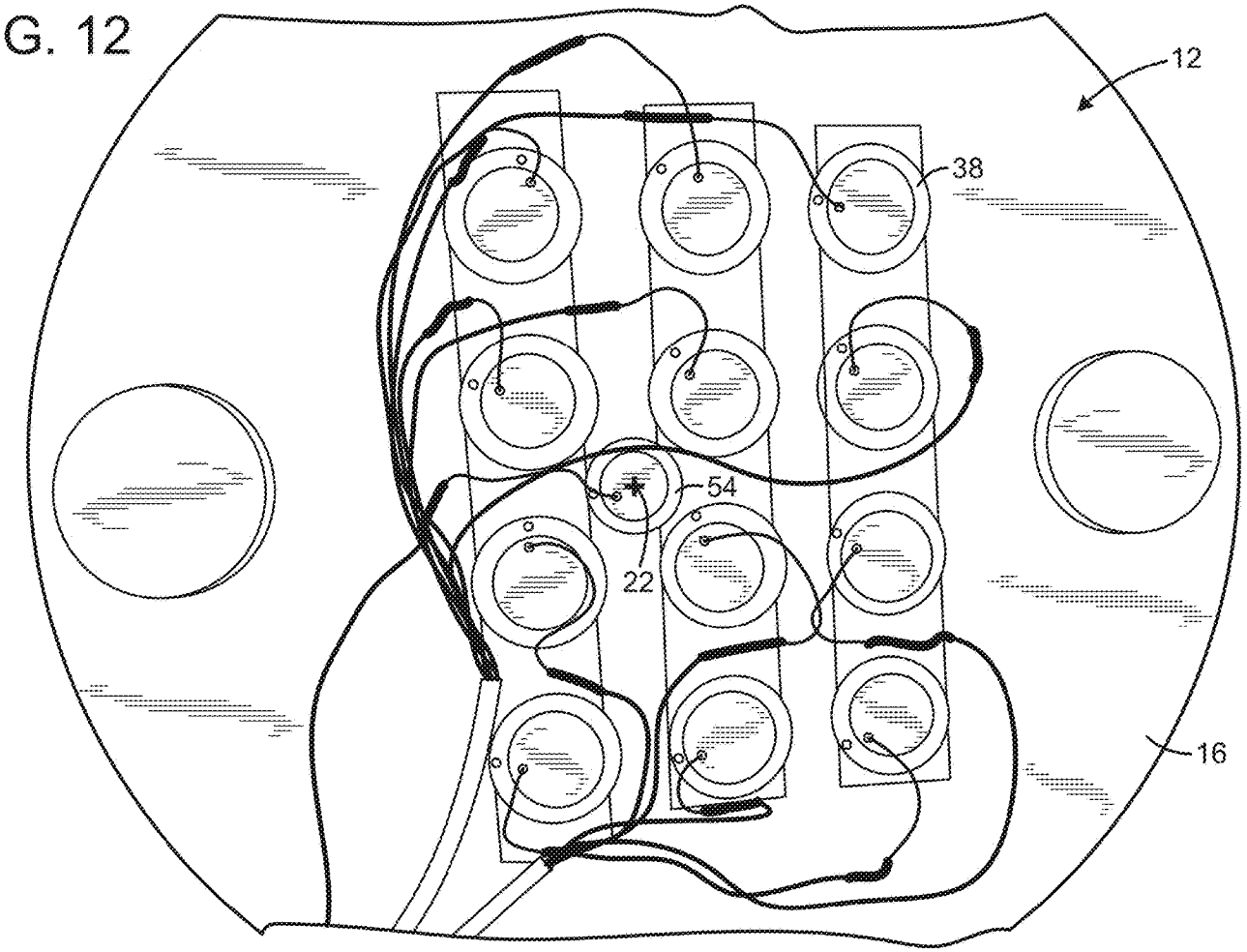
FIG. 12 is a rear view of the shooting target system showing the wake up sensor of FIG. 5.

FIG. 12 illustrates a wake-up sensor 54 of the target shooting system 10 attached to a target plate 12. More particularly, the wake-up sensor is not a member of the location sensor array composed of sensors 38 and is preferably located in the center 22 of the target plate 12 under the main circuit board 26 (not shown). The wake-up sensor is located in the center of the target plate to maximize the likelihood the wake-up sensor will register an impact anywhere on the target plate, thereby activating the wake-up sensor circuit 300.

Figure 13:
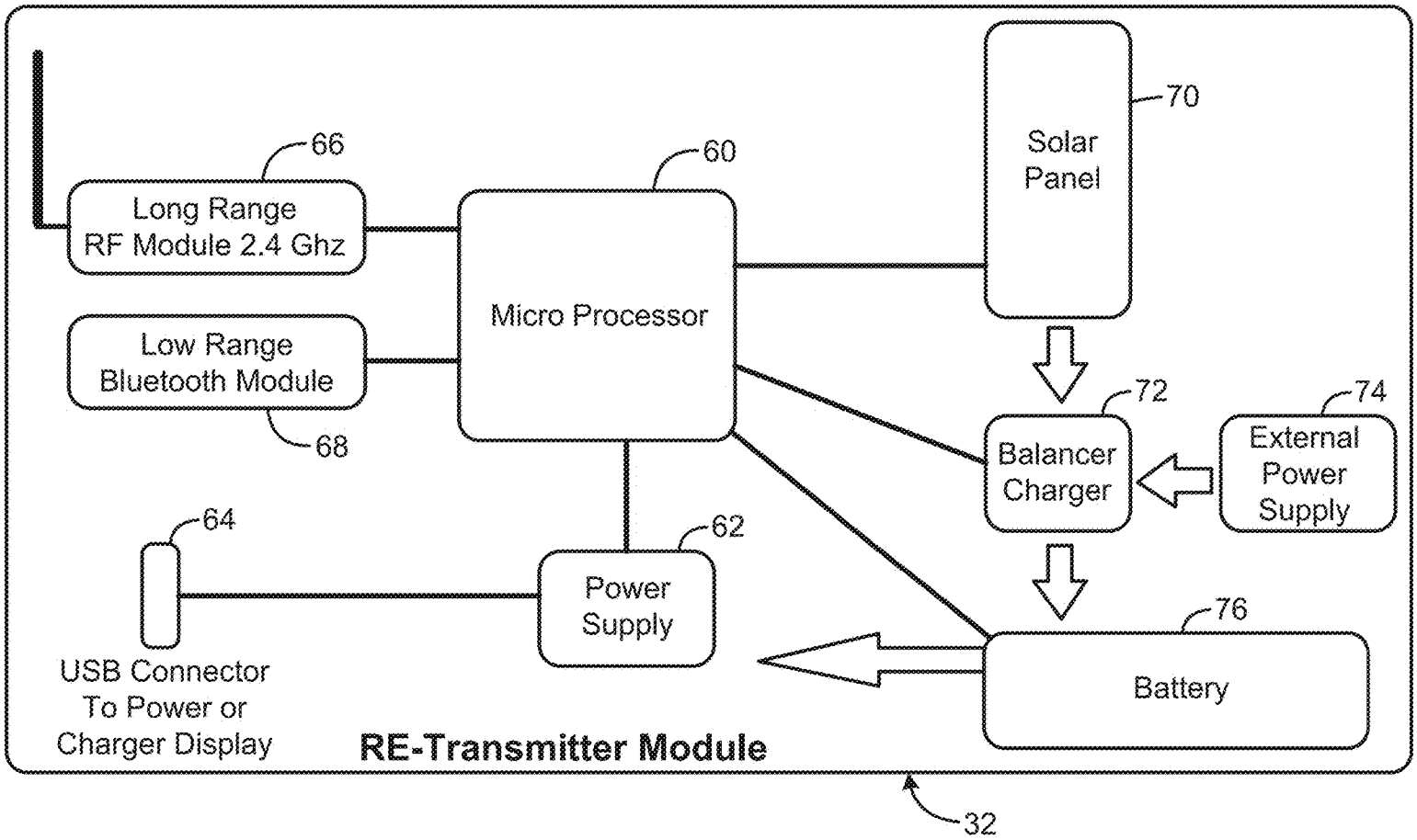
FIG. 13 is a schematic diagram of the retransmission module/interface module of the shooting target system.

FIG. 13 is a schematic diagram of the retransmission module/interface module 32 of the shooting target system 10. The retransmission module/interface module is the interface between the target plate 12 and the display device 34 of the shooter 36. The retransmission module/interface module eliminates the need for internet access in order for the display device to receive information from the target plate. The retransmission module/interface module receives long range radiofrequency signals from the RF module 42 and antenna 28 on the target plate and retransmits it, preferably using a low range Bluetooth® module 68, to the display device. This retransmission module has an internal battery 76 that powers the retransmission module/interface module. The retransmission module/interface module can include a power supply 62 with the USB connector 64 to power or charge the display device. The solar panel 70 charges the battery through the internal balancer charger 72. The retransmission module/interface module also includes a microprocessor 60 and can be optionally connected to an external power supply 74. Although wireless communication capabilities are preferred, wired connections can also be used between the retransmission module/interface module, target plate, and/or the display device.

The data the microprocessor 60 receives from the target plate 12 can include the location of the most recent bullet impact (X-Y position), identification of the sensor(s) activated by the most recently impacting bullet, the charge level of the battery 48, the amount of power being generated by the solar panel 70, the current value of the countdown timer, and the total quantity of bullet impacts. The RF module 42 can also receive data from a weather station 30. All of this information, and the status of the retransmission module/interface module's internal battery 76, are transmitted by the low range Bluetooth® module 68 to the display device 34. In the current embodiment, the retransmission module/interface module can be located up to 1000 meters from the target plate and up to 100 meters from the display device without losing contact. For longer distances, additional retransmission module/interface modules can be used.

Figure 14:
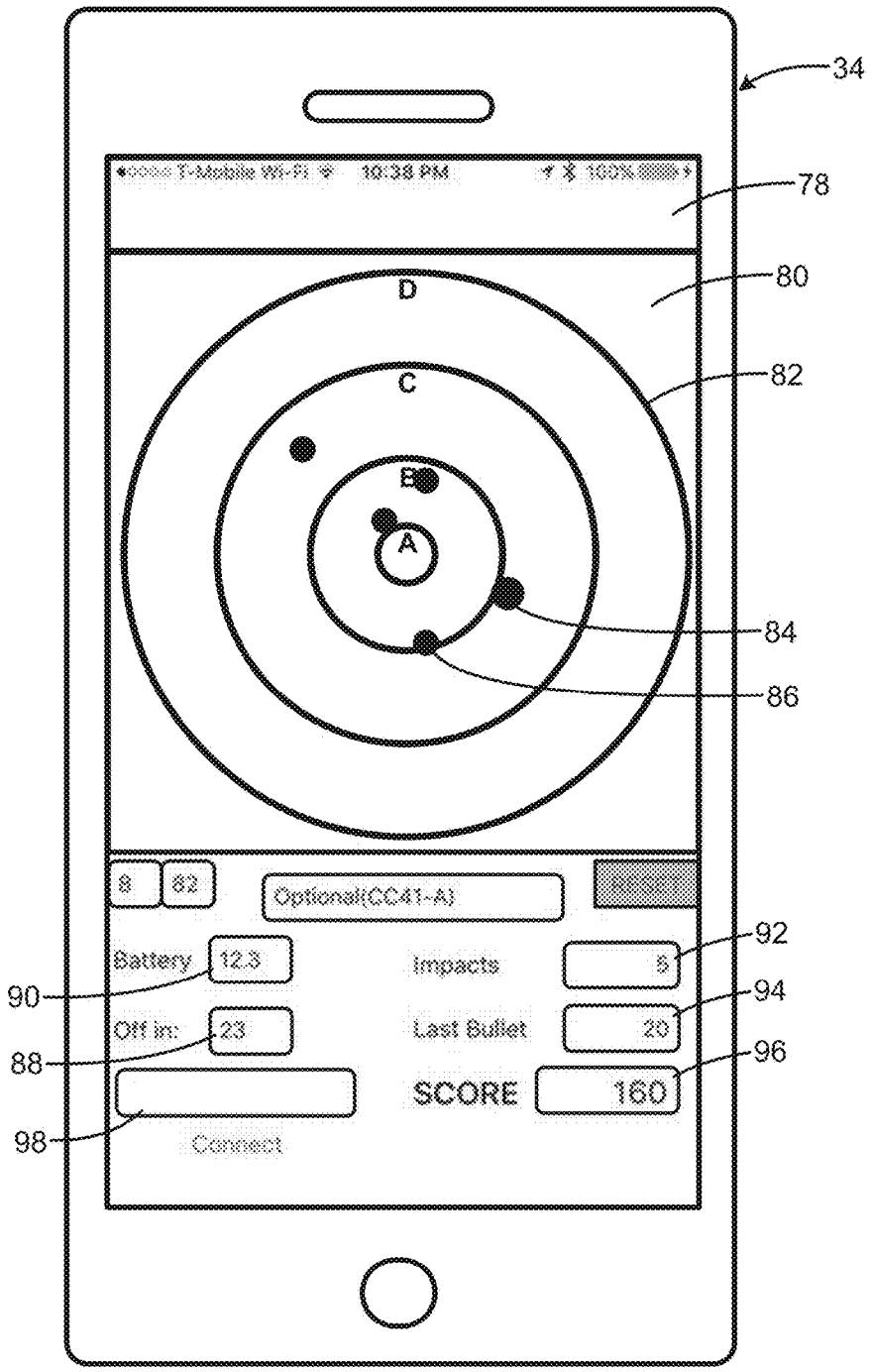
FIG. 14 is a front view of a display device running the display component of the shooting target system.

FIG. 14 illustrates the display component 78 of the shooting target system 10 running on a display device 34. More particularly, the display device can be a tablet, smartphone, handheld computer, portable computer, or any device with a display that can run software and exchange data with the retransmission module/interface module 32 of the shooting target system, preferably via Bluetooth®. A software application executes on the display device, interprets the data received from the retransmission module/interface module, and displays the data to the user. The displayed data can include bullseye indicia 82 denoting the major central portion of the plate and one or more intermediate portions registered with the aiming point 22 and extending away from the aiming point toward the periphery in all directions. The displayed data can also include the most recent impact location 84, previous impact location(s) 86, the current value 88 of the countdown timer, the charge level 90 of the battery 48 of the target plate 12, the impact count 92 on the target plate, the score of the last impact 94, the total score for all impacts 96, and a target plate connection status indicator 98.

The display device 34 can also have the ability to modify parameters associated with using the target plate 12, such as assigning a target plate identifier, shooter identifier, countdown timer starting value, REF_HI and REF_LOW values, and the initial number of bullets in the magazine of the firearm 38. These parameters can be stored in memory in the display device, retransmission module/interface module, and/or on the main circuit board 26. The software application can also have the ability to incorporate rules enabling the user to practice for a specific type of tournament or to compete online as an individual or as part of a team.

Additionally, the application may enable the user to select from multiple target plates when more than one target plate is present.

Figure 15:
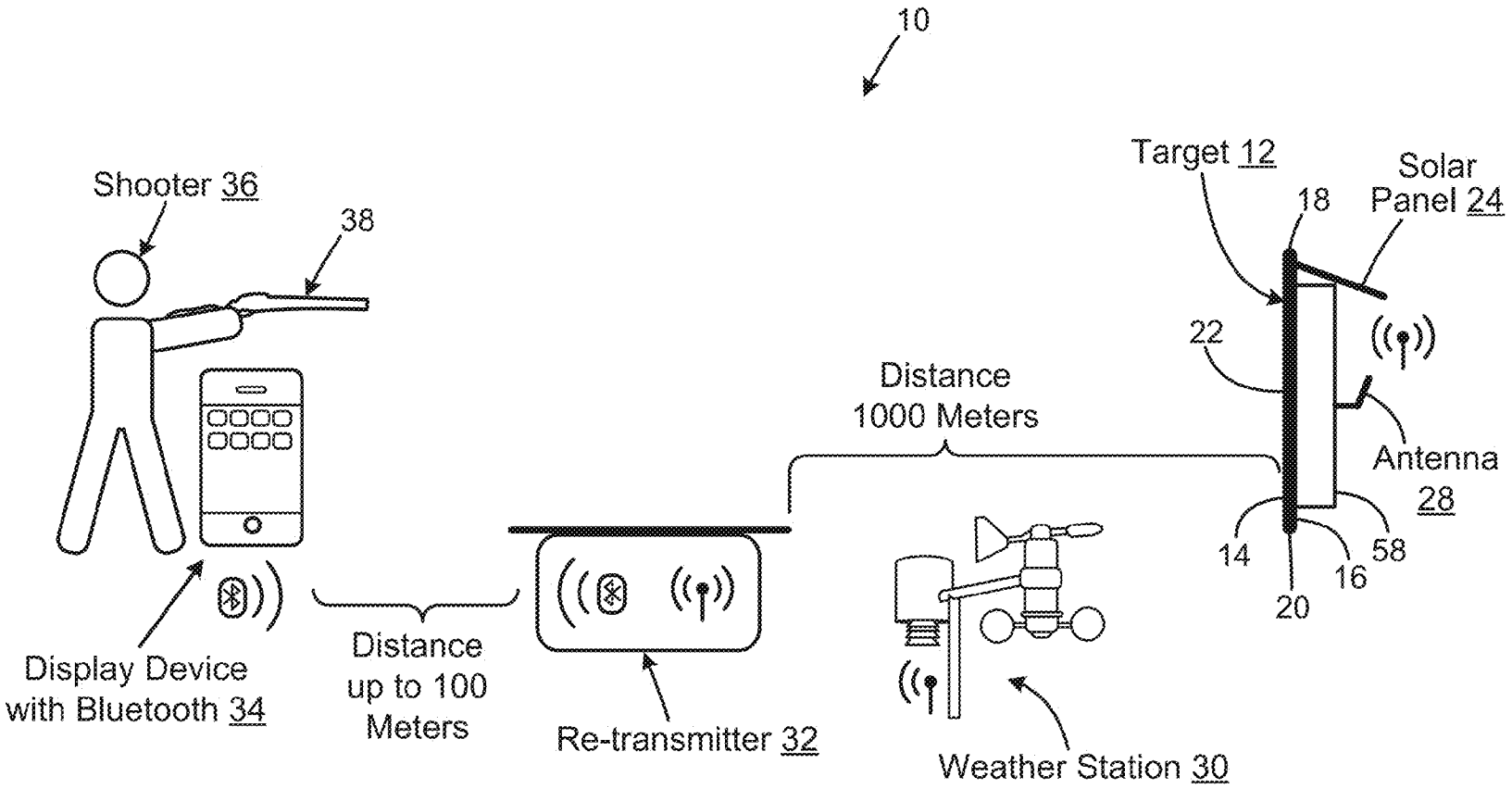
FIG. 15 is a schematic diagram view of the shooting target system in use.
Figure 16:
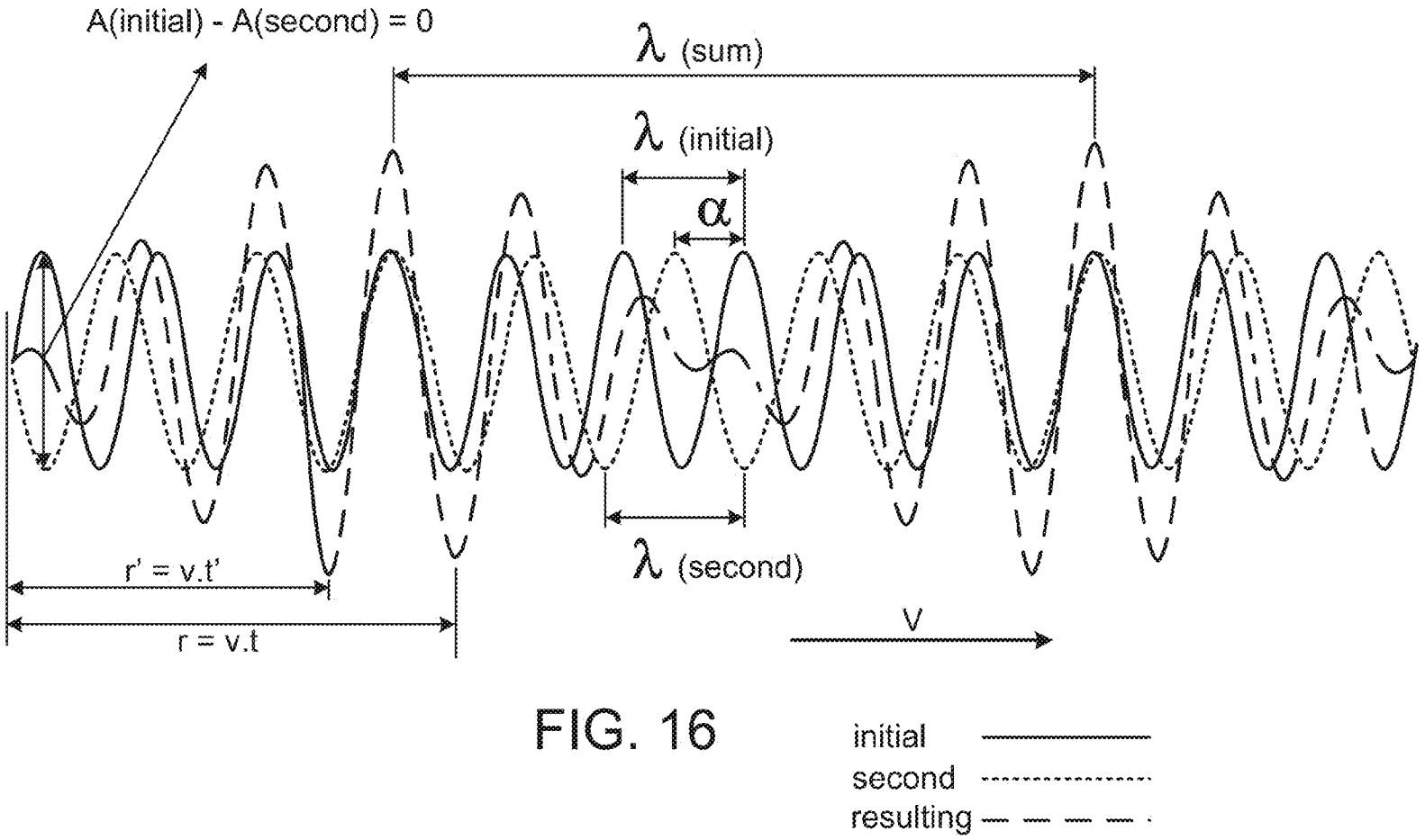
FIG. 16 is a graphical representation of the initial wave, secondary wave, and their combination into a resulting wave.

FIG. 15 illustrates the shooting target system 10 in use. More particularly, the weather station 30 is a multiple sensor device that can measure temperature, wind speed, humidity, rain conditions, sun, and any other weather-related parameter. The weather station preferably uses a battery to supply power. An internal RF transmitter sends data about the measured weather conditions to the retransmission module/interface module 32, which subsequently sends the weather data to the display device 34. The weather station has sufficient communication range that the weather station can be positioned well away from both the shooter 36 and the target plate 12 to avoid inadvertent bullet strikes on the weather station. The solar panel 24 is attached to the rear 16 of the target plate below the top 18 so the solar panel is protected from inadvertent bullet strikes. The antenna 28 protrudes from the housing behind and below the top of the target plate to maximize the range of the RF module 42 while preventing inadvertent bullet strikes on the antenna. Because the sensors 38 are comparatively inexpensive, the target plate with attached sensors can be viewed as a consumable portion of the shooting target system that can be affordably replaced when the target plate has become excessively dimpled.

An optional microphone (not shown) can be used as part of the shooting target system 10 to listen for the report of the firearm 38. If the target plate 12 does not subsequently detect a bullet impact after a pre-determined window of time, then the shooting target system reports the target plate 12 was missed to the shooter 36 via the display device 34. The detected firearm reports can also be used as a shot counter and subtracted from a known initial quantity of ammunition in a shooter's magazine to show the remaining rounds available in the magazine on the display device.

While a current embodiment of a shooting target system has been described in detail, it should be apparent that modifications and variations thereto are possible, all of which fall within the true spirit and scope of the invention. For example, any suitably bullet-resistant material can be used instead of the steel plate described, including fiberglass, polycarbonate, polyethylene, and aluminum plates. In addition, the circuits described can be implemented using digital signal processors or other types of electronic circuits to measure the signals generated by the sensors. Besides the piezoelectric sensors described, laser vibration sensors, infrared vibration sensors, and optical fiber Bragg grating vibration sensor array are suitable for use with the invention. Furthermore, although a target plate has been disclosed, the current invention is also suitable for use with vehicle panels to determine the location of projectile impacts and an approximation of where the projectile originated from. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A shooting target system comprising:

a target plate having a front face adapted to be struck by aimed projectiles without said aimed projectiles penetrating said front face;

an opposed rear face;

an orthogonal array of spatially equidistantly placed sensors applied to cover the major central portion of said opposed rear face of the plate where each sensor center is the same distance from each adjacent sensor center in both the X and Y directions;

each said sensor having an output connection and being responsive to projectile impact force and/or vibration on the target plate in response to a projectile strike to generate a strike signal on the output connection;

a processor connected to each of the sensors;

said processor operable, in response to the projectile strike, to determine which of said sensors is/are first activated by the projectile strike, the sequence of activation, and the time of activation during a limited time interval after the projectile strike, where said processor is operable to calculate a projectile strike location based on the location, sequence and timing of the activated sensors during said limited time interval;

said sensor activation determined upon a selected or preselected upper and lower threshold and the creation of a voltage above said lower threshold and below said upper threshold;

a timer;

said timer activated through processor interruption, via front face contact with said projectile, which in turn prompts said timer to activate and produce a picture of each said activated, and inactivated, sensor based on location, sequence and timing, assign each sensor a binomial number within said picture based on received impact and to calculate and produce an average of sensor signals' binomial number to determine a precise impact location; and a real-time visual display capable of both informing the shooter of accuracy and allowing the shooter to adjust and correct his or her aim.

2. The system of claim 1 wherein said projectile strike is a first projectile strike and said sensor is the sensor closest to said first projectile strike where said first projectile strike interrupts said processor, initiates said timer and activates said closest sensor or sensors to receive input via a generated impact or voltage, based on each sensor's output connection sensitivity, that is above or below a selected or preselected threshold.

3. The system of claim 2 wherein each threshold may be preselected or tunable to a threshold that is adjustable to accommodate different energy levels of different subsequent projectiles and different rates of fire.

4. The system of claim 1 wherein said processor is responsive to a single activated sensor to generate a calculated projectile strike location at or near the center of said sensor.

5. The system of claim 1 wherein the processor is responsive to a pair of equidistant and adjacent activated sensors to generate a calculated projectile strike location based on said projectile strike sufficiently close to either a vertical or horizontal axis between two adjacent sensors resulting in a calculated impact nominally at a midpoint of a line connecting the centers of said pair of adjacent activated sensors.

6. The system of claim 1 wherein the processor is responsive to an L-shaped trio of equally spaced and adjacent activated sensors to generate a calculated projectile strike location at a geometric average of the locations of the centers of the equally spaced and adjacent sensors.

7. The system of claim 1 wherein the processor is responsive to a square of four equidistant and adjacent activated sensors to generate a calculated projectile strike location at an area within a square formed by connecting the centers of the four adjacent sensors.

8. The system of claim 1 wherein said array of sensors comprises an orthogonal grid wherein groups of four sensors in a box formation are positioned where each sensor is equidistant from each adjacent sensor in an X and Y axis as to utilize location, sequence and timing to assign each activated sensor a binary number captured in a window or picture which is then combined and divided by the number of activated sensors in order to accurately calculate an averaged position of a projectile strike.

9. The system of claim 1 wherein said target plate includes an aiming point at an intermediate location away from a periphery of the target plate and wherein the array of sensors has an intermediate portion registered with the aiming point and extending away from the aiming point toward the periphery in all directions.

10. The system of claim 1 wherein said array of sensors comprises at least three rows and three columns of sensors.

11. The system of claim 1 wherein said array of sensors comprises at least eight rows and eight columns of sensors.

12. The system of claim 1 wherein said array of sensors comprises at least 9 sensors.

13. The system of claim 1 wherein a resilient material exists between said target plate and said array of sensors that serves as a shock absorber between said target plate front face and said sensors, thereby sparing the sensors, while providing sufficient sensitivity for proper sensor functioning.

14. The system of claim 12 wherein the resilient material is an elastomer.

15. The system of claim 1 wherein the processor includes a memory location map in an X and Y axis for each sensor or group of sensors, each memory location storing a current status for each sensor, where said processor is operable in response to detecting at least one memory location having a current status corresponding to a strike signal to determine the current status of all the memory locations within a limited time interval before sensors away from the actual projectile strike location register the strike signal.

16. The system of claim 1 wherein the processor is subject to a pre-programmed window of time during which the impact shock wave from said projectile is allowed to propagate within the target plate material before the sensor's condition is recorded, signified as t1, and a second window of time wherein at least one output signal is recorded and said impact shock wave is allowed to dissipate to a point of inactivity, signified as t2 which operates to determine the status of all the sensors before a shockwave from the projectile strike reaches the sensors away from the projectile strike location.

17. The system of claim 1 wherein the sensors are piezoelectric speakers, laser vibration sensors, infrared vibration sensors or fiber optic sensors.

18. A method of determining a strike location on a ballistic plate, the method comprising:

providing the ballistic plate with a front strike surface having a central target area and a rear surface having an array of orthogonally placed, equidistant sensors distributed across a rearward-facing array area concentrated in the central target area;

triggering the interrupting of a microprocessor, via a projectile strike force falling within a specified selected threshold REF Hi and REF_LOW voltage value range, which activates a timer;

preprogramming a timer to reflect 2 times, t1 and t2, in which both t1 and t2 start with said projectile strike force and t2 extends longer than t1;

allowing a vibration created by said projectile strike force to propagate within the target plate material for the entirety of t1;

beginning recording the sensor's condition at the end of t1 while t2 continues where t2 reflects the duration of time at least one sensor triggers an output signal from a comparator;

recording the signal output of at least one sensor via a clock signal wherein all memory of sensor output data is captured, simultaneously, and retained;

assigning a binary number of each affected sensor in terms of sequence, location and timing;

storing that binary number in the processor;

calculating an averaged projectile strike location and projectile intensity above an adjustable, selectable voltage threshold based on the locations of the sensors that the shockwave has reached, the sequence of activation and the time in which each sensor is activated; and mapping the affected sensors on an X and Y axis; and relaying the received information, via output connectors, to the shooter by way of a display device thus allowing the shooter to adjust and correct subsequent aimed projectile strikes; and continuing to measure signal decay defined by the end of t2 where said comparator no longer produces an output, sensors are deemed inactive and may accept another impact.

19. A shooting target system comprising:

a ballistic plate having a front face adapted to be struck by aimed projectiles;

an opposed rear face;

a plurality of sensors applied to the rear face of the ballistic plate;

a resilient elastomer layer between each of the sensors and the ballistic plate;

each sensor having an output connection and being responsive to strike force and/or vibration of the ballistic plate, in response to a projectile strike, to generate a strike signal on the output connection;

a processor connected to each of the sensors and operable to receive sensor activation information, above an adjustable, selected voltage threshold, and time of individual sensor activation in order to activate a timer, allowing for a predetermined short time interval to pass and for impact wave propagation to occur, in which time the activation information is collected, simultaneously, in the form of a picture based on location, sequence and timing from all associated sensors to determine and calculate a projectile strike intensity and location average by dividing the average of signals received;

said each associated sensor or group of associated sensors generating an impact above said voltage threshold which is assigned a binomial number based on received impact intensity that is used to calculate and produce an average of each sensor signals' binomial number or group of sensors signals' binomial numbers to determine a precise impact location;

a retransmission module/interface for information transmittal; and a display device that provides information to the shooter in the form of received data for aim adjustment and correction, countdown timer, battery charge level, scores, and ballistic plate status and condition all in real time.

20. The shooting target system in claim 19, wherein said associated sensors are chosen from a list of 1 to 4 sensors wherein:

said processor responsive to a single activated sensor that may generate an average calculated projectile strike location at or near the center of said single activated sensor;

said processor responsive to a pair of equidistant and adjacent activated sensors to generate an average calculated projectile strike location based on wherein the projectile strikes sufficiently close to either a vertical or horizontal axis between two adjacent sensors resulting in a calculated impact nominally at a midpoint of a line connecting the centers of the adjacent activated sensors;

said the processor is responsive to an L-shaped trio of equidistant and adjacent activated sensors to generate an average calculated projectile strike location at a geometric average of the locations of the centers of the equidistant and adjacent sensors; and said processor being responsive to a square of four equidistant and adjacent activated sensors to generate a calculated projectile strike location at an area within a square formed by connecting the centers of the four adjacent sensors.

* * * * *